United States Patent [19]

Yamashita et al.

[11] Patent Number: 4,809,036

[45] Date of Patent: Feb. 28, 1989

[54] ELECTROSTATIC IMAGE APPARATUS UTILIZING DISTORTION FREE DEVELOPMENT MEANS

[75] Inventors: Mitsuo Yamashita; Shinji Nakagawa, both of Tokyo, Japan

[73] Assignee: Kabushiki Kaisha Toshiba, Kawasaki, Japan

[21] Appl. No.: 109,397

[22] Filed: Oct. 19, 1987

[30] Foreign Application Priority Data

Oct. 20, 1986 [JP] Japan ..... 61-249027

[51] Int. Cl.[4] ..... G03G 15/08

[52] U.S. Cl. ..... 355/3 DD; 355/14 D

[58] Field of Search ..... 355/3 DD, 14 D; 29/117, 29/129

[56] References Cited

U.S. PATENT DOCUMENTS

| | | | |
|---|---|---|---|
| 358,472 | 3/1887 | Nourse | 29/117 |
| 2,975,758 | 3/1961 | Bird, Jr. | 355/3 DD |
| 3,147,147 | 9/1964 | Carlson | 355/3 DD |
| 4,410,259 | 10/1983 | Yamagata et al. | 355/3 DD |
| 4,498,756 | 2/1985 | Hosoya et al. | 355/3 DD |
| 4,521,098 | 6/1985 | Hosoya et al. | 355/3 DD |
| 4,718,154 | 1/1988 | Bauer | 29/129 X |

FOREIGN PATENT DOCUMENTS

| | | | |
|---|---|---|---|
| 449855 | 7/1936 | United Kingdom | 29/117 |

*Primary Examiner*—A. C. Prescott
*Assistant Examiner*—Jane Lau
*Attorney, Agent, or Firm*—Foley & Lardner, Schwartz, Jeffery, Schwaab, Mack, Blumenthal & Evans

[57] ABSTRACT

A developing apparatus is disclosed which includes a rotatable development sleeve which carries a non-magnetic one-constituent toner on a surface thereof. When the development sleeve rotates, the toner thereon is transferred to an electrostatic latent image, an elastic blade being urged against the surface of the development sleeve, to ensure that the layer of toner thereon is of uniform thickness. The interior of the development sleeve has a ribbed structure which provides additional structural rigidity.

10 Claims, 3 Drawing Sheets

ELECTROSTATIC IMAGE APPARATUS UTILIZING DISTORTION FREE DEVELOPMENT MEANS

BACKGROUND OF THE INVENTION

This invention relates to a developing apparatus for use in an electronic photographing apparatus, such as an electronic copying apparatus, a facsimile, or a printer, and, in particular, to a developing apparatus for developing an electrostatic latent image into a visible representation by use of a one-constituent developing agent or the like.

In the conventional electronic photographing apparatus, the cascade method and the magnetic brush method, are the primary development methods employed.

In recent times, a method for effectively developing an image to be printed in a superimposed fashion, that is, for developing an electrostatic latent image on the surface of an electrostatic latent image formation area in a non-contact fashion, has extensively been studied in view of the current preference for color image recordings.

Conventionally the method of this type is generally called a non-contact developing method as achieved by a developing apparatus of FIG. 1.

In this developing apparatus, elastic blade (coating blade) 4 is pressed against development sleeve 2, to form a uniform layer of a toner T thereon. The toner layer is triboelectrically charged upon passing between development sleeve 2 and elastic blade 4.

As is shown in FIG. 2, development sleeve 2 is positioned, by a pair of gap adjusting rings 8, relative to photosensitive drum 6, which provide a small gap G therebetween, so that the layer of the toner T faces an electrostatic latent image in close proximity thereto. A bias voltage is then applied between development sleeve 2 and photosensitive drum 6, to cause to the toner T on development sleeve 2 to fly across gap 4 and attach itself to the electrostatic latent image on drum 6. Toner T attaches itself only to a high-voltage area of the electrostatic latent image, never to a low-voltage area thereof. More specifically, if the bias voltage applied across sleeve 2 and drum 6 is a D.C. bias voltage, that part of toner T which faces the low-voltage area remains on sleeve 2. On the other hand, if the vias voltage is an A.C. bias voltage, that part of toner T which faces the low-voltage area moves toward drum 6 but is immediately drawn back onto sleeve 2. In either case, that part of toner T which faces the high-voltage area moves from sleeve 2 to drum 6 and is deposited on the high-voltage area. In this way, toner T selectively attaches itself to the electrostatic latent image, to develop it into a visible image.

Conventional development sleeve 2, being of simple hollow-cylindrical type, is structually weak when a bending force is applied thereto. The development sleeve, when pressed by elastic blade 4, develops a warp S, as is shown in FIG. 2 due to pressure f exerted by elastic blade 4 thereon.

When the development position $B=0°$ as shown in FIG. 3, when elastic blade 4 is pressed from the angular position $90°+\alpha°$ to the position of development sleeve 2, then a variation in a gap G resulting from the warpage of development sleeve 2 is represented by $S \sin \alpha$.

In this way, the gap G between photosensitive drum 6 and development sleeve 2 varies due to a warp S of development sleeve 2 by an pressure from elastic blade 4, thus causing the gap G to becomes narrower than its predetermined value. As a result, there is the problem of a poor quality image at the time of development.

Development sleeve 2, if being made "solid" as distinct from "hollow", undergoes less warpage, but the weight of the resulting structure is increased by that extent.

In the conventional developing apparatus using a magnetic two-component toner or a magnetic one-component toner, a magnet is located inside the development sleeve. It is therefore impossible to locate any reinforced member inside the development sleeve.

SUMMARY OF THE INVENTION

It is accordingly the object of this invention to provide a developing apparatus of a simple structure which can decrease a variation in a gap between an electrostatic latent image in a developing position and a developing means and can obtain a better development without involving any nonuniform variation in concentration level as well as in the lines of an image.

According to an aspect of this invention a developing apparatus is provided which comprises:

movable developing means carrying a developing agent on the surface and adapted to transfer the developing agent to an electrostatic latent image;

layer forming means adapted to urge the developing agent against the surface of the developing means to form a developing agent layer thereon; and rigidity adding means provided relative to the rear surface of said developing means to give an added structural strength to the developing means.

In this developing apparatus thus manufactured, an added structural strength can be imparted to the developing means without increasing a weight as in a solid counterpart. Thus a gap in a developing position between the electrostatic latent image and the developing means can be less likely to be decreased so that a better developing image can be obtained on the developing apparatus.

DETAILED DESCRIPTION OF THE PREFERRED EMBODIMENT

A developing apparatus according to one embodiment of this invention will be explained below with reference to the accompanying drawings.

Figure 4:
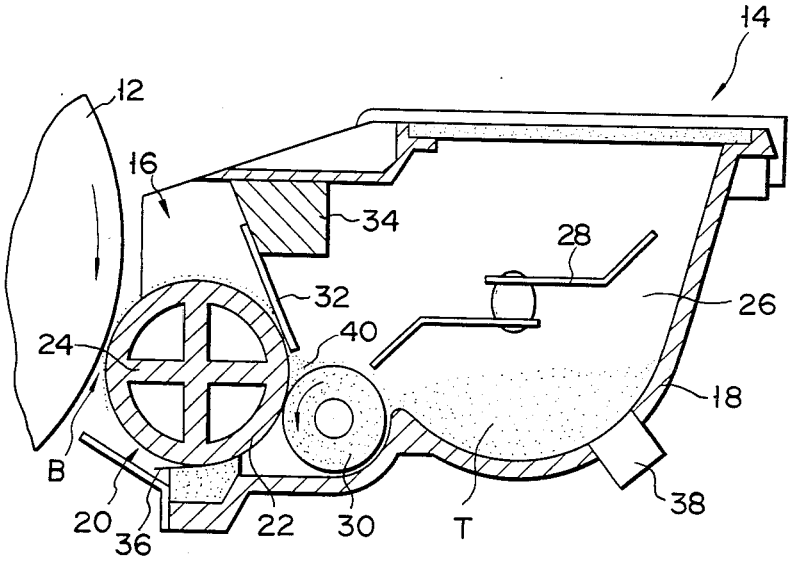
FIG. 4 is a cross-sectional view diagrammatically showing a developing apparatus according to one embodiment of this invention.

In FIG. 4, photosensitive drum 12 is fitted within an electronic photographing apparatus, not shown, and adapted to be rotated in a direction as indicated by the arrow in FIG. 4. Developing apparatus 14 is located relative to the periphery of photosensitive drum 12. Developing apparatus 14 includes casing 18 having opening 16 located opposite to photosensitive drum 12. Developing roller 20 is rotatably mounted within casing 18 and comprised of cylindrical development sleeve 22 and ribs 24 formed on the inner surface of sleeve 20. Development sleeve 22 is partly exposed from opening 16 of the casing and located opposite to photosensitive drum 12. Development sleeve 22 is located, by a gap adjusting ring (not shown), relative to the surface of photosensitive drum 22 to leave a gap therebetween.

Toner storage section 26 is formed within casing 18 where a triboelectrically chargeable, nonmagnetic one-component toner T is stored. Vane-like stirring member 28 is fitted within toner storage section 26 to prevent the cavitation of the toner T. Supply roller 30 is located between stirring member 28 and development sleeve 22 to supply the toner T within toner storage section 26 to development sleeve 22.

Elastic blade 32 is fitted within casing 18 and supported by holder 34 such that it imparts a predetermined pressure to the surface of development sleeve 22. Elastic blade 32 serves to form a uniform layer of a predetermined thickness on the surface of development sleeve 22 and to press the toner against development sleeve 22 to allow the toner to be triboelectrically charged to a desired type of charge. Recovery blade 36 is provided within casing 18 to recover from development sleeve 22 the toner T which has been left at the time of development. Detector 38 is also provided at casing 18 to detect that the residual toner within toner storage section 26 becomes smaller.

With the rotation of supply roller 30, a proper amount of toner T is deposited on the surface of supply roller 30 to supply it to development sleeve 22. In accordance with the rotation speed of developing roller 20 and an amount of toner on supply roller 30 a small amount of toner T is crowded, as reservoir 40, between development sleeve 22 and supply roller 30. The toner T, while being triboelectrically charged, but not sufficiently, on the way to supply roller 30, is sequentially covered on the surface of development sleeve 22.

The toner T deposited on the surface of development sleeve 22 is pressed by elastic blade 32 against development sleeve 22 to allow it to be formed as a uniform layer of a predetermined thickness on development sleeve 22 and charged to a desired type of charge.

The toner layer thus charged on development sleeve 22 is brought in proximity to photosensitive drum 12 with the rotation of development sleeve 22 and faces photosensitive drum 12. A DC bias voltage or an AC bias voltage for development is applied across photosensitive drum 12 and development sleeve 22 to cause the toner T on development sleeve 22 to be transferred to an electrostatic latent image on photosensitive drum 12 by the action of such bias voltage. In this way, the electrostatic latent image is developed into a visible image.

Figure 5:
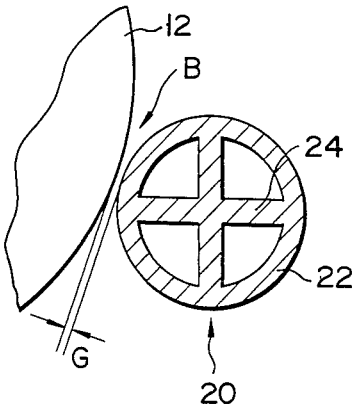
FIG. 5 is a cross-sectional view showing a development sleeve and ribs of the apparatus of FIG. 4.

Aforementioned ribs 24 are provided inside development sleeve 22 as shown in FIGS. 4 and 5 to provide an added rigidity against the bending force of development sleeve 22 so that the development sleeve is not flexed. In this way, it is possible to give extra rigidity to development sleeve 20 as a whole. Ribs 24 have a cross-like cross-section as a whole and radially extend from the axis of development sleeve 22. Ribs 24 and development sleeve 22 are formed of an extrusion molding. Ribs 24 are of a one-piece molded type and continuously extend from end to end of development sleeve 22.

The warp of development sleeve 22 as caused upon urging development blade 32 against development sleeve 22 can be given by a simple calculation equation below:

$$S=(W/6EI)\cdot X$$

on the assumption that

X: a position along the axis of development sleeve 22

S: a warp on the position X

W: a uniform distribution load per unit length of the sleeve under an urging force of elastic blade 32

E: the modulus of longitudinal elasticity of the material of development sleeve 22

I: the second moment of area of sleeve 22

The warp S occurs in inverse proportion to the second moment of area, I, and modulus of longitudinal elasticity, E. That is, the greater the second moment of area, I, and modulus of longitudinal elasticity, E, the smaller the warp S.

Thus, as the modulus of longitudinal elasticity, E, or second moment of area, I, increases, the warp S becomes smaller, provided that the weight W is constant. Since the modulus of longitudinal elasticity, E, is the inherent value of the material of development sleeve 22, the use of another modulus of longitudinal elasticity means that a different material is used for development sleeve 22.

In general, since a material whose modulus of longitudinal elasticity is greater has a greater weight, development sleeve 22 is unavoidably increased.

Where the development sleeve is of a hollow type, the second moment of area becomes:

$$I=(\pi/64)\,(d_2^4-d_2^4)$$

where $d_1$ and $d_2$ denote the inner and outer diameters, respectively, of the development sleeve.

For the second moment of area, I, to be increased, $d_1=0$. If developing roller 20 is replaced by a solid round rod, then the amount of warps become minimal. However, if developing roller 20 becomes heavy, the developing apparatus has to be manufactured as having an added structural strength so that such a heavy developing roller may be incorporate therein. It is not preferable that the amount of warp of developing roller 20 (development sleeve 22) be decreased by increasing the second moment of area, I.

Figure 1:
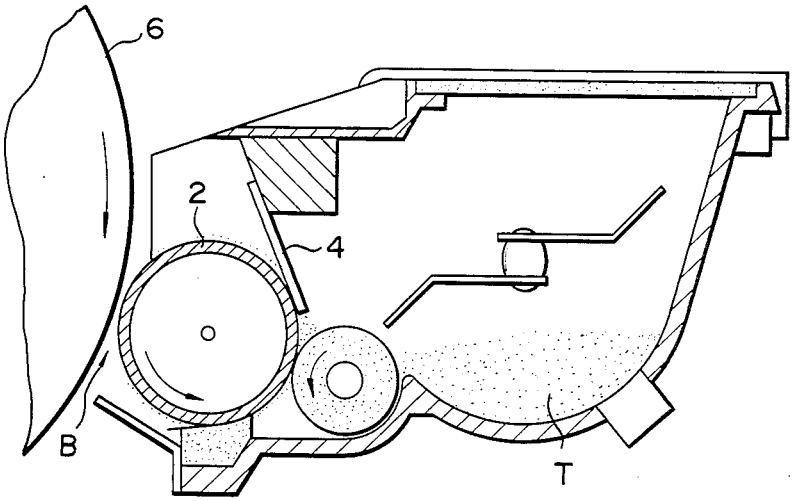
PRIOR ART FIG. 1
FIG. 1 is a cross-sectional view diagrammatically showing a conventional developing apparatus.
Figure 2:
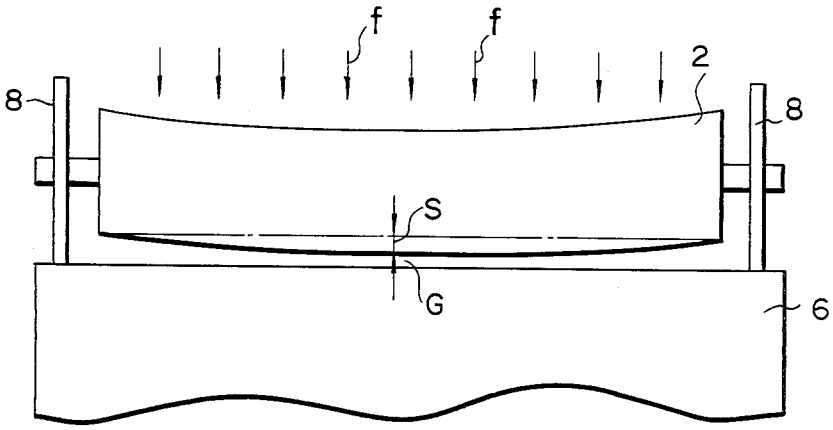
PRIOR ART FIG. 2
FIG. 2 is an explanative view showing the state of a warpage of a development sleeve as urged by an elastic blade.
Figure 3:
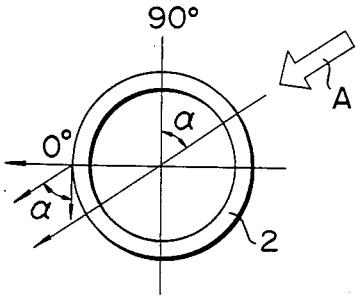
FIG. 3 is a view for explaining a variation in a gap resulting from a warpage of the development sleeve.

By providing ribs 24 inside development sleeve 22 of a hollow, cylindrical type, as shown in FIG. 3, the value of the second moment of area of development sleeve 20 is increased over that of a simple hollow, cylindrical type, without appreciably increasing the whole weight of developing roller 20. In this way, developing roller 20 has an added flexural rigidity, that is, development sleeve 22 is given an added structural strength through ribs 24 so that the warp S is decreased.

In developing roller 20 thus arranged, the rigidity of developing sleeve 22 is increased due to the presence of ribs 24 and thus there is no possibility that the gap G at a developign position between photosensitive drum 12 and development sleeve 22 will be made narrower than a predetermined value due to the warpage of development sleeve 22. As a result, better development can be achieved without involving a variation in a concentration level and in image lines.

Figure 6:
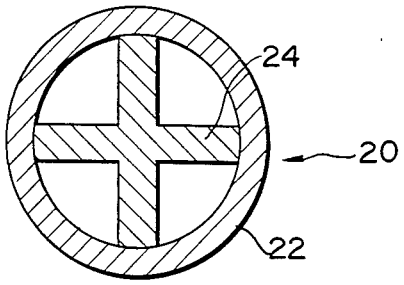
FIGS. 6 and 7 each show a variant of a development sleeve and ribs of FIG. 5.

In the aforementioned embodiment, ribs 24 are formed integral with sleeve 22 such that they are located inside development sleeve 22. However, ribs 24 may be made separate from development sleeve 22 so that an integral ribbed structure may be forced into development sleeve 24 as shown in FIG. 6.

Figure 7:
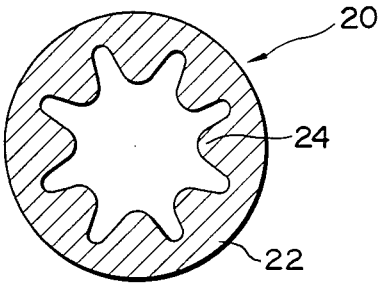

The rib structure may have a cross-sectional configuration as shown in FIG. 7 or may be of a substantially Y-shaped type or be of a honeycomb type (a benzene-ring array).

What is claimed is:

1. A developing apparatus comprising:

movable developing means carrying a developing agent on its surface and adapted to transfer, during its movement, the developing agent to a photosensitive drum, thereby to form an electrostatic latent image, said movable development means being supported for rotation by a shaft in the center thereof;

layer-forming means adapted to press the developing agent against the surface of said developing means, to form a layer of developing agent thereon said movable developing means being positioned a predetermined distance from said photosensitive drum, said photosensitive drum and said layer forming means being located oppositely each other in relation to said movable developing means, the shaft of said movable developing means positioned therebetween; and rigidity-adding means provided relative to the rear surface of said developing means, to endow said developing means with additional structural strength.

2. The developing apparatus according to claim 1, wherein said developing means including a cylindrical sleeve.

3. The developing apparatus according to claim 2, wherein said rigidity-adding means including a ribbed structure inside said cylindrical sleeve.

4. The developing apparatus according to claim 3, wherein said rib structure is formed integrally with said cylindrical sleeve.

5. The developing apparatus according to claim 4, wherein said sleeve and said rib structure are formed of an extrusion-molded aluminum.

6. The developing apparatus according to claim 2, wherein said rigidity-adding means is so formed that the ribs of said ribbed structure extend radially from the longitudinal axis of said sleeve.

7. The developing apparatus according to claim 2, wherein said rigidity-adding means is formed continuously along the axial direction of said sleeve.

8. The developing apparatus according to claim 1, wherein said developing means transfers said developing agent to an electrostatic latent image in a non-contact fashion.

9. A developing apparatus comprising:

movable developing means carrying a developing agent on its surface and adapted to transfer, during its movement, the developing agent to a device for forming an electrostatic latent image;

layer-forming means adapted to press said developing agent against the surface of said developing means, to form a layer of developing agent thereon, while triboelectrically charging the developing agent; and rigidity-adding means provided on the rear surface of said developing means to endow said developing means with structural strength.

10. The developing apparatus according to claim 9, wherein said developing agent is a nonmagnetic one-component toner.

* * * * *